United States Patent [19]

Brewer

[11] 3,966,129

[45] June 29, 1976

[54] REFUSE PROCESSING EQUIPMENT

[75] Inventor: John C. Brewer, Salt Lake City, Utah

[73] Assignee: Garbalizer Corporation of America, Salt Lake City, Utah

[22] Filed: May 7, 1975

[21] Appl. No.: 575,474

[52] U.S. Cl. ..... 241/79.1; 241/DIG. 38

[51] Int. Cl.[2] ..... B02C 23/08

[58] Field of Search ..... 241/79.1, 246, 278 A, 241/284, DIG. 38

[56] References Cited

UNITED STATES PATENTS

| | | | |
|---|---|---|---|
| 2,721,035 | 10/1955 | Lankford et al. | 241/79.1 |
| 3,224,839 | 12/1965 | Pierson | 241/DIG. 38 |
| 3,738,483 | 6/1973 | MacKenzie | 241/DIG. 38 |
| 3,814,336 | 6/1974 | Brewer | 241/79.1 |
| 3,856,217 | 12/1974 | Brewer | 241/79.1 |

*Primary Examiner*—Granville Y. Custer, Jr.

[57] ABSTRACT

Structure for preparing heterogeneous refuse material in a manner conducive to relatively inexpensive and direct, further processing. A principal portion of the structure includes a revolving chamber having a central fixed shaft provided with an auger end. A fixed ring portion cooperates with such auger end and is disposed in proximity with the revolving chamber such that the auger may force-feed the chamber with incoming refuse. Impact or mauling-arm means are provided within the revolving chamber for effectively mauling the material passing therethrough, as by gravity feed, so that bundles of garbage tend to be broken-up. In a preferred form of the invention conveyor means are provided for separating out ferrous metals and air-classifying the remaining refuse for further processing.

17 Claims, 6 Drawing Figures

REFUSE PROCESSING EQUIPMENT

The present invention relates to refuse material processing systems and, more particularly, provides new and improved structure for "mauling" or tearing up compacted garbage to render the same more loose and, hence, more susceptible to classification, shredding, and other processing.

A very active field currently under consideration is the subject of processing systems for municipal waste. For all types of waste systems it is desirous for incoming refuse to be suitable for shredding, by way of example, or other processing. Yet, refuse such as household garbage waste is often compacted, itself packaged in small compact form, and such refuse has to be broken up, i.e. subjected to mauling agents, so as to loosen the garbage, break open the bags and bundles, and so forth.

The present invention supplies such a basic structure in having a revolving housing, generally circular, which is carried on a fixed shaft. The latter is provided with an auger for force-feeding incoming refuse into the revolving chamber. Such chamber is provided with a series of mauling arms or other means for breaking open bags, bundles, and other compacted refuse. In one form of the invention, the mauling arms used are actually fixed to the revolving drum or chamber; the latter is canted to effect a gravity pass-through of materials in conjunction with the mauling action inherent in the equipment. Auger means is supplied in the invention for force feeding the mauler type chamber.

Once materials are broken up, then, in an extended form of the invention, conveyor belt means are provided to effect separation from the refuse of ferrous materials, and subsequently an air-classification of the remaining refuse so that "heavies" such as rock, plaster, non-ferrous metals and so forth, can be carried for further processing by one conveyor means, whereas the remaining materials, blown to a second conveyor can be conveyed directly to a shredding mechanism, for example. In this way, the shredder mechanism subsequently used need not have provision made for overload, such as shear pins in the blade structure, and so forth. A stack or outlet conduit may be provided for conveying fines and lightweight materials to still another point for further processing.

Accordingly, a principal object of the present invention is to provide structure for preprocessing waste materials such as municipal refuse, this so that such refuse material may be introduced into other structure for further, convenient, and inexpensive processing.

An addition object is to provide structure for mauling municipal waste so as to break up the heterogeneous materials therein and thereby permit easy separation and/or processing of such waste material.

A further object is to provide a refuse mauler system which combines the advantages of a hopper and auger force feed with a later, impact arm revolving stage.

A further object is to provide structure for preprocessing waste material wherein the same includes a mauler stage for breaking apart refuse, to be followed by conveyor means and air-classification means suitable for separating out ferrous metals and also heavy materials and lighter weight materials.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

Figures 1, 1A, 1B:
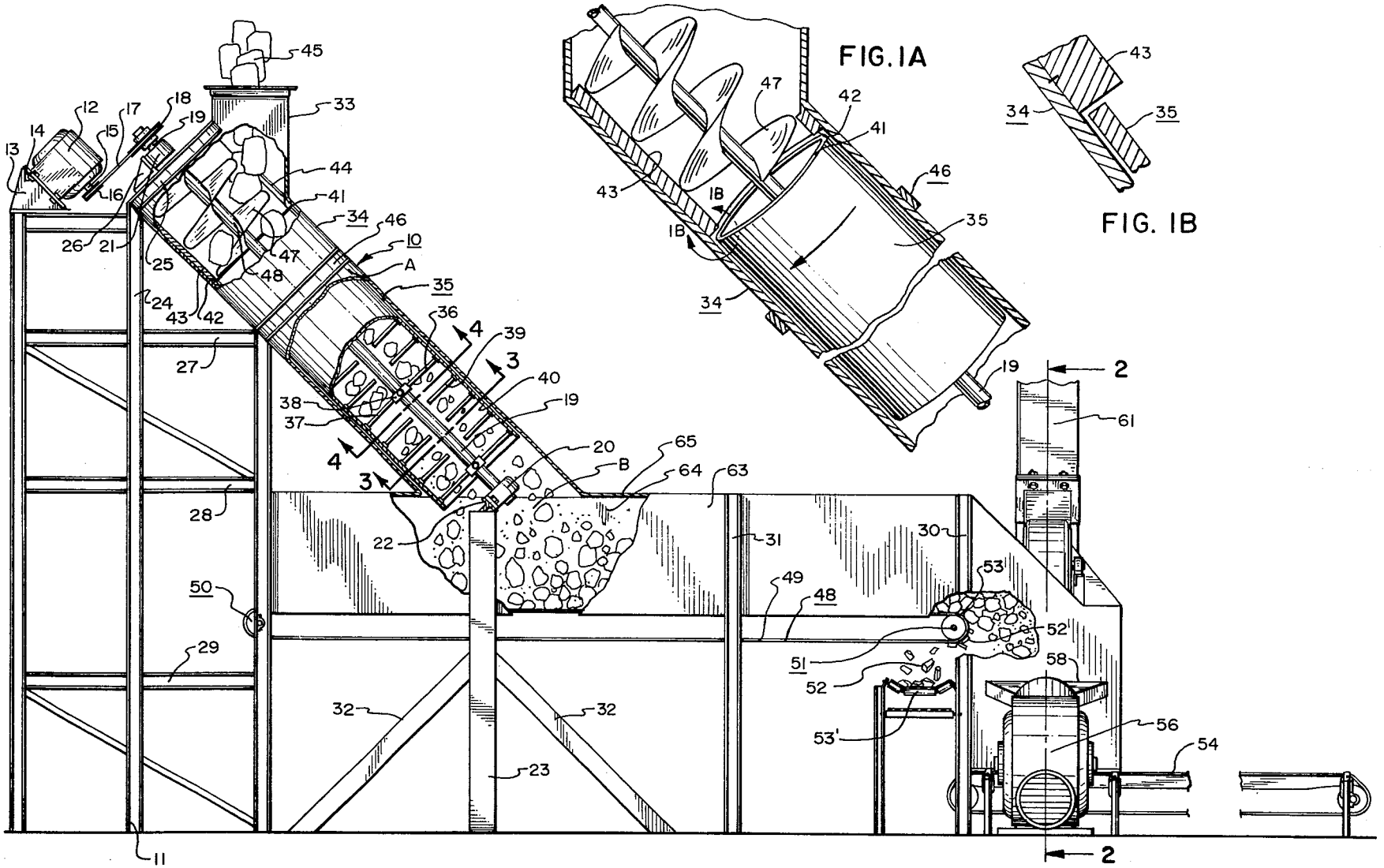
FIG. 1 is a side elevation of structure representing a first embodiment of the subject invention incorporating ther necessary mauler stage.
FIG. 1A is an enlarged, fragmentary perspective of a portion of FIG. 1.
FIG. 1B is an enlarged detail taken along the line 1B—1B in FIG. 1A;.
Figure 3:
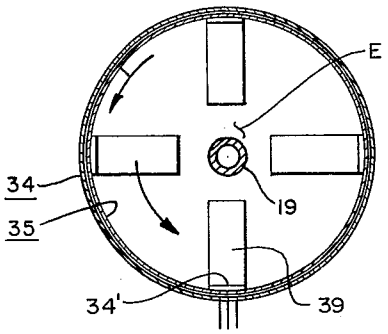
Figure 4:
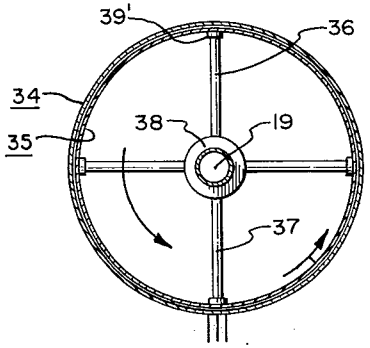
Figure 2:
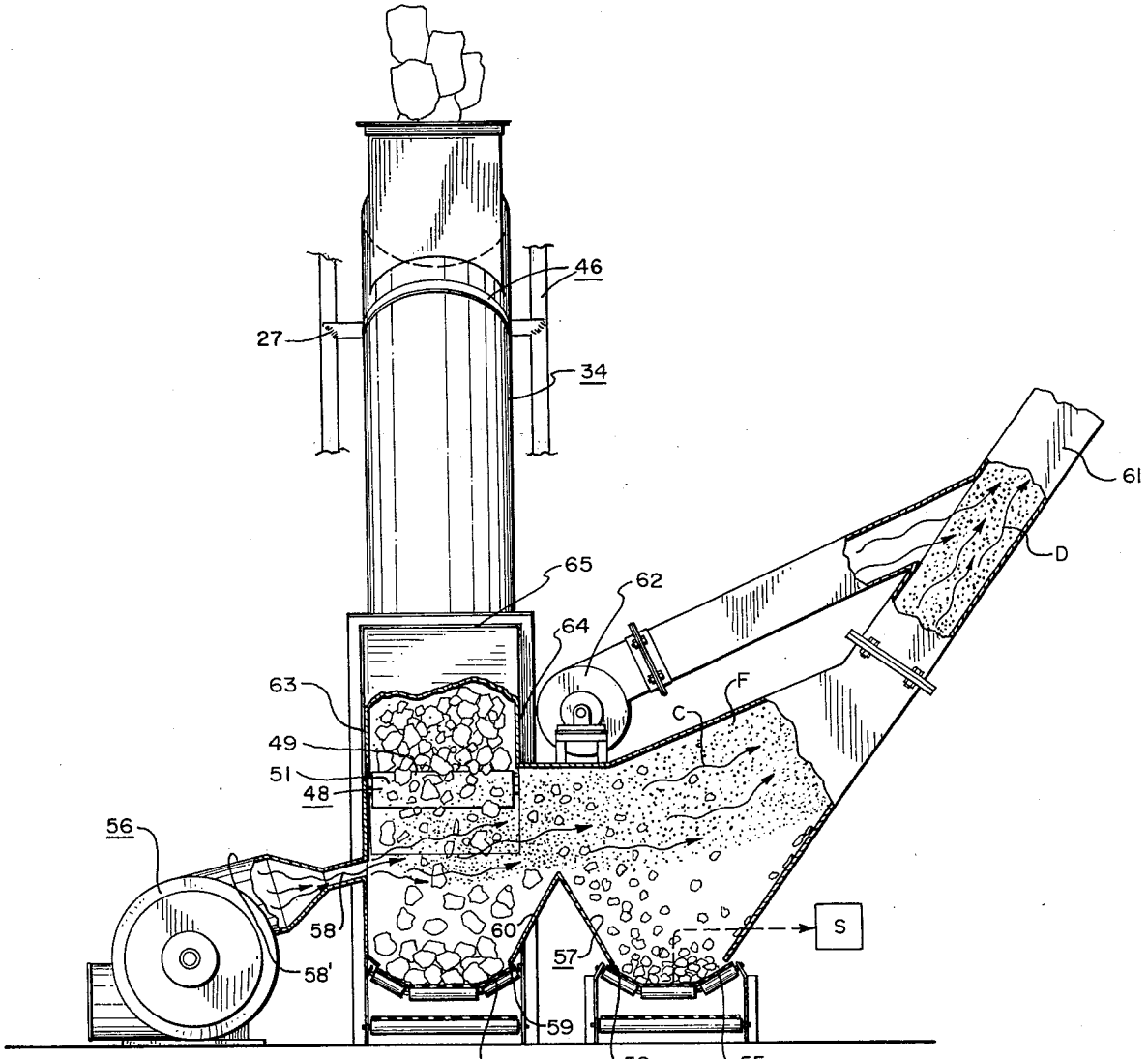

FIG. 2 is a section taken along the line 2—2 in FIG. 1, illustrating the air-classification and conveyor means permissibly used in conjunction with the mauler equipment of the invention, and FIGS. 3 and 4 are transverse sections taken along the lines 3—3 and 4—4, respectively, in FIG. 1.

In FIG. 1 the subject materials' pre-processing and separation structure is designated by the numeral 10 and includes a support structure 11 to which prime mover 12 is fixedly mounted, as by bracket 13 and attachment bolts 14. The prime mover will take the form of a large electrical motor or combustion engine, by way of example, and will include output shaft 15 provided with keyed, drive pulley 16. Belts 17 intercouple the same with driven pulley 18 affixed to shaft 19. The shaft 19 is provided with a duplicate numeral designation at its opposite extremities as journaled to and within pillow-block bearings 20 and 21. These bearings are mounted to the support structure 11 at cross-bar 22, the latter being secured to opposed braces 23, one being shown, and also to upstanding posts 24, one being shown. A front plate 25 can be welded in place, secured to posts 24, and provide a mount for bracket 26. The latter, of course, carries bearing 21.

There are several structural members as, for example, 27–32 in FIG. 1 which serve as support structure by way of example. Of course, it will be understood that other types of supports may be employed. Conveyor side baffle plates 63 and 64 and contiguous interspanning top 65 are provided. The provided arms 36, see FIG. 1, may be termed "mauling arms" and are provided for mauling, stirring or agitating the debris as is gravity-fed through the chamber 35. Also, there are series of mauling arms or radial plates 39 which can be welded or otherwise secured to the inside surface 40 of the revolving chamber 35 and protrude inwardly, see FIG. 3.

The upper annular edge 41 of the revolving chamber 35 is shown in FIG. 1 and is proximate to, yet slightly spaced from, the edge 42 of ring 43. Ring 43 is a fixed, arcuate plate that is fixedly disposed within and secured to the bottom and sides of a housing but which, of course, is open or apertured at 44 to permit the reception of refuse 45 in hopper 33. Further band-securement bracing structure as at 46 can be employed to secure the housing 34 in place. While but a single revolving chamber 35 alone can be provided, without the inclusion of the axial, fixed shaft 19, it is believed appropriate for the fixed outer shell or housing 34 still to be used, and especially at the location at which ring 43 is fixedly installed in fixed housing 34.

The ring or arcuate auger plate 43 is in proximity with and essentially peripherally touches or at least works with the auger portion 47, mounted on shaft 19 at portion 48, so there is actually a forced-feeding of refuse received from hopper 33 into the interior of revolving chamber 35. The mauling arms 39 that are affixed to the inside wall of the revolving chamber 35, as well as the spokes or arms at 36 and 37, serve in conjunction with gravity in breaking up and tearing packaged or compacted refuse, small bundles of refuse, and otherwise serve to "maul" or loosen up the refuse as the same gravity descends to from point A to point B, see FIG. 1.

First conveyor 48 comprises an endless conveyor belt 49 which is secured over end rollers 50 and 51; the latter are journaled to support structure 11 as shown. Roller 51 may be a ferrous magnetized roller of magnetized iron or steel, for example, so as to permit various particules 52 to cling to belt 49 at the forward end 53 thereof as the same proceeds about such roller. Thus, once the ferrous-metal particles 52 move further underneath and rearwardly relative to the roller 51, the influence of the magnetized drum or roller 51 will be lessened so that these debris elements or particles 52 will actually drop out, onto endless conveyor belt 53'.

FIG. 2 illustrates that there are second and third conveyors as at 54 and 55. The second conveyor 54 is disposed essentially in line with the first conveyor 49, and is in essentially the same axial vertical plane as the former but is substantially beneath the same, of the order of 8–10 feet, in the manner shown in FIGS. 1 and 2.

Also provided is an air-classifier blower 56 which is provided with a shroud 58' having a forward horizontally-elongate slot 58 to accommodate the passage of a horizontal jet of air in the direction shown by C. The shroud 58' may be developed by a generally circular configuration to an essentially slotlike horizontal configuration as shown at 58 in FIG. 1, to provide for the blast of air C coming from blower 56. It is noted that the blower is oriented such that the air blast or air jet is directed not only transversely across conveyors 54 and 55 but also upwardly along an angulated line indicated by the arrow D. This is for the purpose of conveying the light weight materials appropriately past the separating riser or semi-partition 57. The latter has a transverse cross-section in the form of an inverted-V with the margins thereof overlapping the margins 58 and 59 of conveyors 54 and 55. This semipartition permits generally heavy materials falling on the windward side of riser 57 to slide down the side 60 back into the second conveyor at 54. Such materials may include heavy materials such as non-ferrous metals, plaster, rock, rubber, wood, and other generally heavy debris. The lighter materials such as cellulose garbage, plastics, and paper are carried by the air stream C onto the third conveyor 55. The fines and extremely light-weight materials at F, such as dust, mica, cloth bits, etc. in such jet stream at the position F at FIG. 2, are carried up stack 61 for further processing.

As to the stack 61, an auxiliary blower 62 may be provided to increase the air draft and velocity of air-entrained particles at the stack or final conduit area.

FIGS. 3 and 4 are enlarged to show clearly the form in which the fixed spokes or arms 36 and 37, for example, may be secured not only to shaft 19, by hubs 38, but also are secured as by welding or by sockets 39' to the inner wall of the revolving chamber, see FIG. 4. Correspondingly, there may be provided the mauler arms as at 39 which, while free from the shaft, so as to prevent material to pass through the open central area E, nonetheless are secured at their outer ends 34' to the inner wall of the revolving chamber 35.

The structure as described operates as follows.

Refuse 45 is introduced into hopper 33 to enter into the auger area composed of auger 47 and arcuate auger plate or ring 43. The refuse may take a number of forms, is generally heterogeneous, and may include items such as leather and plastics, rubber, rock and stone, wood products, and household garbage including vegetable waste, cellulose materials such as paper and cloth and so forth. It will be observed that many homes now use compactors by which refuse is compacted very tightly and then deposited in garbage cans in a packaged, compacted form. Other types of municipal waste are tightly bound together in bales. There may be leaves and grass cuttings that have compacted together and so on.

What is needed, therefore, and what is provided in the present invention is an auger which is operative to forcefeed debris entering hopper 33 into revolving chamber 35. Auger 47 in this regard coacts with auger ring 43 in a manner similar to that of meat grinders. This action precludes any backing up of materials being processed or pre-processed by the equipment.

The slight annular recess or spacing between ring 43, see FIGS. 1A and 1B and the upper edge 41 of revolving chamber 35 will be sufficiently small, say 0.010 inches, such that little if any debris or dust will enter in at this point. And if such does enter, the same will simply slip downwardly between the housing and the revolving chamber 35. It is noted that the ring 43, fixed to fixed housing 34 is oversized in the sense that the cross-sectional diameter of the space in the ring will be less that that of the circular wall of revolving chamber or drum 35. This is to provide an essentially free flow of debris from the ring area into the revolving chamber.

It is noted that the chamber and housing are canted or slanted downwardly, declining at an angle approximately 45° in magnitude. This is for the purpose of permitting the mauling arms, whether of the type at 36, 37 in FIG. 3 or of the type shown at 39 in FIG. 4, or both in breaking open any bundles, bags or sacks present, and also loosening or mauling the debris as the same proceeds downwardly between the arms 39 in FIG. 3 and the arms 36 and 37 in FIG. 4, and also through space E in FIG. 3, thus the loosened particles now fall in essentially a semi free-fall condition to the point B in FIG. 1. Such loosened debris drops upon conveyor 48 and is carried by conveyor 49 about end roller or drum 53. As before mentioned, this drum is magnetized such that any ferrous materials on the conveyor belt will ride around the forward end of the conveyor and drop on the conveyor 53' as shown.

The non-ferrous material that is not so carried around in such U-shaped fashion will fall downwardly toward conveyor 54 in FIG. 2, whereupon the heavy materials will fall downwardly through the air stream as produced by blower 56. Accordingly, conveyor 54 carries all of the heavies, e.g. rock, glass, brick, tire portions, etc. Such materials can be simply transported to a dump area or subjected to further processing. The remaining lighter materials are carried by the jet stream C in the area above conveyor 55. Such materials will be household vegetable matter, papers, and in general the lighter materials that may be found in refuse. These materials are readily available for immediate processing such as by routing directly to a shredder. It is noted that the materials in being so routed to a shredder, for example, are free of very heavy materials carried by conveyor 54 which, if not previously removed, would require shear pins or other excess load relief provision for the shredder being utilized.

Fine and/or light-weight materials are further carried by the jet stream C as now aided by auxiliary blower 62, into conduit or stack 61 for routing to a shredder, to a ball mill, or to any other processing desired.

The combination of the revolving chamber 35, housing 34, and hopper 33, may be thought of and considered to be a declining receiver for receiving refuse as at 45 in FIG. 1. Conduit 61 in FIG. 2 may be oriented outwardly, upwardly, or disposed simply in an upwardly canted position. Revolving chamber 35 is preferably tubular, comprising essentially a barrel.

What is provided, therefore, is new and improved structure wherein compacted garbage and refuse may be loosened or mauled, and the bundles and bags thereof broken up so that materials can be processed directly, separated and air-classified, as desired, for desired processes. The revolving chamber incorporating the mauling arms is suitable for breaking up bags and bundles such that loosened particles of refuse emerge from the discharge end of the chamber as at B in FIG. 1.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A materials' pre-processing and separation structure including, in combination, support structure, a declining receiver mounted to said support structure, said declining receiver having an upper input hopper and a revolving chamber provided with an input end communicating with said hopper for receiving contents therefrom and also with outlet end, said chamber being provided with interior refuse-impact arms, an elongate first conveyor having a feed end disposed underneath said outlet end and also a discharge end horizontally separated from said feed end, said first conveyor being provided with ferrous metals' separating means proximate said discharge end thereof, second and third essentially parallel, side-by-side conveyors disposed at a level beneath that of said first conveyor, said second conveyor extending forwardly of but being essentially in the same axially elongate vertical plane with said first conveyor, said second conveyor having a receiving end disposed beneath said discharge end of said first conveyor, and air-classifying blower means for directing a stream of air transversely across said second and then said third conveyor for blowing light materials descending from said discharge end of said first conveyor toward said third conveyor.

2. The structure of claim 1 wherein said declining receiver includes a stationary housing shell secured to said support structure and revolvably containing this chamber.

3. The separation structure of claim 1 wherein said first conveyor comprises a pair of spaced end rollers journaled to said support structure and an endless belt operably secured thereof, that one of said rollers proximate said discharge end of said first conveyor being of magnetized material.

4. The structure of claim 1 wherein a raised semi-partition is provided between said second and third conveyors.

5. The separation structure of claim 1 wherein said blower means is directed transversely upwardly across said second and third conveyors for directing an upwardly canted air stream thereacross.

6. The separation structure of claim 1 wherein said support structure includes a housing means disposed above and inwardly in communication with said second and third conveyor, for constraining air flow from said blower.

7. The structure of claim 2 wherein said support structure includes mutually spaced bearing means, said chamber having a central fixed shaft journaled in said bearing means.

8. The structure of claim 2 wherein said chamber includes an upwardly canted shaft provided with an auger disposed underneath and in communication with said input hopper.

9. The separation structure of claim 3 wherein said separation structure is provided with a fourth conveyor disposed underneath and rearwardly of said magnetized materials' end roller.

10. The structure of claim 4 wherein said semipartition has a transverse, inverted-V cross-section overlapping adjacent margins of said second and third conveyors.

11. The separation structure of claim 6 wherein said housing is provided with an exhaust conduit on a side of said third conveyor remote from said blower means, said support structure being provided with auxiliary blower means for supplying an additional air draft through said exhaust conduit.

12. The structure of claim 7 wherein said arms include radial arms attached to and extending outwardly from said shaft.

13. The structure of claim 12 wherein said arms also include inwardly directed arms affixed to said chamber.

14. A device for mauling and thereby impact preparing heterogeneous refuse for further processing, including possible shredder reduction, said device including, in combination, a declining fixed housing having an upper hopper end and a lower discharge end, a revolving chamber axially aligned with and proximate said fixed housing, means for journaling said chamber for axial revolvement with respect to said fixed housing, mauler arms disposed in said chamber, means for axially revolving said chamber, and endless belt-type conveyor means disposed proximate said discharge end.

15. The device of claim 14 wherein said revolving chamber has a central fixed shaft secured thereto and provided with an auger proximate said upper hopper end, said fixed housing having arcuate auger-plate means operably disposed peripherally proximate said auger and spacedly side-adjacent said revolving chamber.

16. The device of claim 15 wherein said auger-plate means is concentric with and of lesser inside diameter than said chamber.

17. In combination, an inclined, revolvably, journaled shaft having an upper portion provided with an auger and also a lower portion, a series of arms extending outwardly from said lower portion, a chamber barrel concentric with said shaft and affixed to said arms, and working surface means operatively surrounding said auger.

* * * * *